US008695132B2

(12) United States Patent
Wu

(10) Patent No.: US 8,695,132 B2
(45) Date of Patent: Apr. 15, 2014

(54) SHOWER HEAD

(76) Inventor: Teng-Chen Wu, Changhua County (TW)

( * ) Notice: Subject to any disclaimer, the term of this patent is extended or adjusted under 35 U.S.C. 154(b) by 769 days.

(21) Appl. No.: 12/980,082

(22) Filed: Dec. 28, 2010

(65) Prior Publication Data

US 2012/0159702 A1 Jun. 28, 2012

(51) Int. Cl.
*A47K 7/02* (2006.01)

(52) U.S. Cl.
USPC ..... 4/606

(58) Field of Classification Search
USPC ..... 4/606
See application file for complete search history.

(56) References Cited

U.S. PATENT DOCUMENTS

| | | | | |
|---|---|---|---|---|
| 6,730,051 | B2 * | 5/2004 | Lin | 4/606 |
| 7,233,078 | B2 * | 6/2007 | Baarman et al. | 290/43 |
| 2010/0083438 | A1 * | 4/2010 | Kao | 4/606 |

* cited by examiner

*Primary Examiner* — Tuan N Nguyen
(74) *Attorney, Agent, or Firm* — Muncy, Geissler, Olds & Lowe, P.C.

(57) ABSTRACT

The shower head is invented with a hydroelectric generator, a motor and an externally equipped brush. When the user turns on the water tap, water goes through the hydroelectric generator inside the shower head and the motor makes the brush either rotate or vibrate while the electricity is received. Accordingly, the shower head allows the user not to only take a shower but also to have body cleaning and body massage.

9 Claims, 6 Drawing Sheets

SHOWER HEAD

BACKGROUND OF THE INVENTION

1. Field of the Invention

The present invention relates to a shower head.

2. Description of the Prior Art

A conventional shower head, as shown in U.S. Pat. No. 6,687,924, is provided with a rotatable brush. Inside the shower head, a water-driven paddle is connected with a gear in order to drive the brush to rotate. Another item equipped in the shower head is a valve which can selectively lead water to drive the paddle wheel so the user can choose whether to use the rotation function.

SUMMARY OF THE INVENTION

The present invention is mainly to emphasize a shower head is equipped with a rotatable and vibrational brush.

To achieve the above purpose, the invention comprises a shower head, a case, a hydroelectric generator, a motor with a power switch, a brush and a transmission mechanism.

The case of the shower head is shaped with an inlet, a flow channel and numerous outlets and the flow channel connects the inlet and the outlets, so that the flow channel enables water to flow through.

The hydroelectric generator is installed inside the case and the hydroelectric generator will generate electricity as a power supply when water flows through the flow channel.

The motor and the power switch are respectively installed inside the case and form a power circuit together with the hydroelectric generator. The power switch is operated to selectively start the circuit that enables the motor to rotate a shaft inside after receiving electricity from the hydroelectric generator.

With the transmission mechanism, there is a gearing relation between the brush and the motor, so that the brush can make rotational movement or reciprocating motion along an axial direction with the rotation of the motor.

The present invention will become more obvious from the following description when taken in connection with the accompanying drawings, which show, for purpose of illustrations only, the preferred embodiment in accordance with the present invention.

BRIEF DESCRIPTION OF THE DRAWINGS

FIG. 4 is a side cross-sectional drawing showing a preferred embodiment of the present invention when the rotation slide switch is turned on;

FIG. 5 is a side cross-sectional drawing showing a preferred embodiment of the present invention when the vibration slide switch is turned on;

DETAILED DESCRIPTION OF THE PREFERRED EMBODIMENTS

Figure 1:
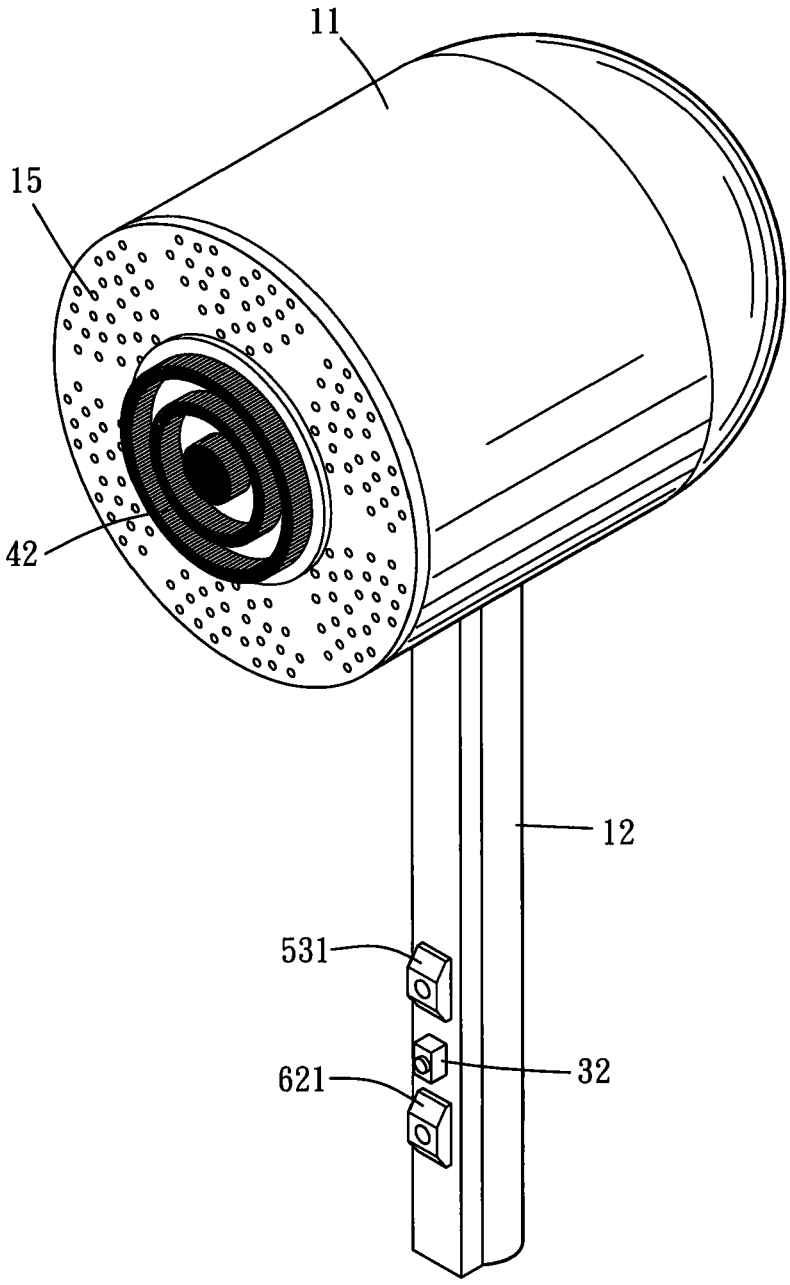
FIG. 1 is a stereogram showing a preferred embodiment of the present invention.
Figure 2:
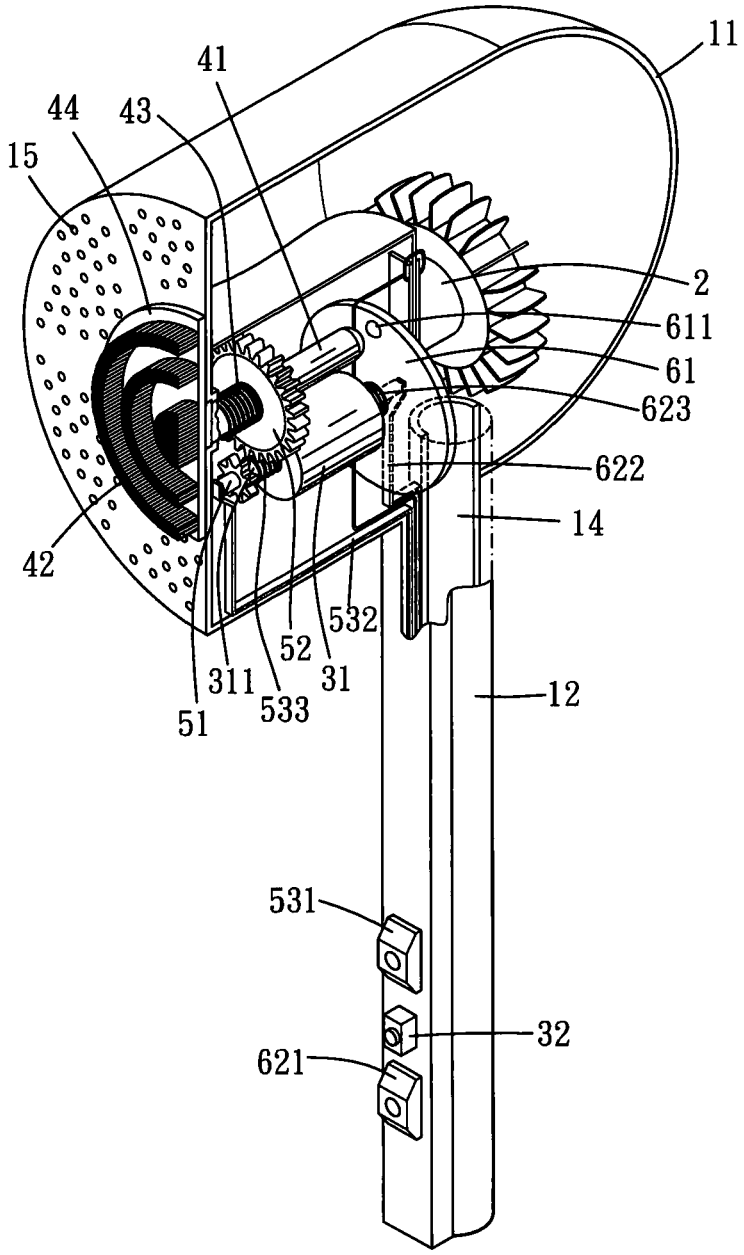
FIG. 2 is a partial cross-sectional drawing showing a preferred embodiment of the present invention.
Figure 3:
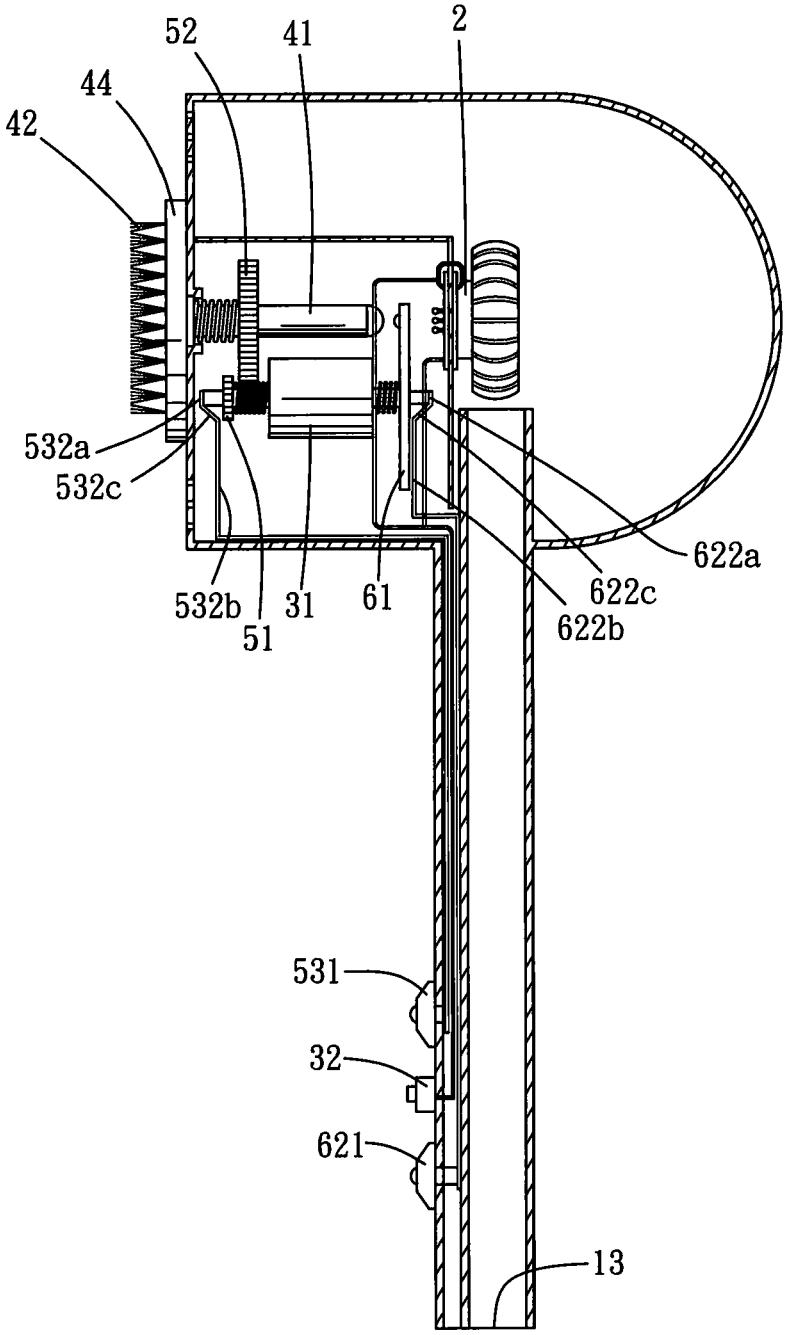
FIG. 3 is a side cross-sectional drawing showing a preferred embodiment of the present invention.

Please refer to FIG. 1 to FIG. 3 for a preferred embodiment of the present invention. The present embodiment of the shower head comprises a case, a hydroelectric generator 2, a motor 31, a power switch 32, a brush 42, and a transmission mechanism.

The case comprises a head portion 11 and a stem portion 12. The stem portion 12 is fixed on the head portion 11. The stem portion 12 is provided for users to grab. The case is shaped with an inlet 13, a flow channel 14 and plural outlets 15. The inlet 13 is located on a distal end of the stem portion 12 to be assembled with a water hose. The inlet 13 connects with the flow channel 14, so that water can flow into the flow channel 14 through the inlet 13. The flow channel 14 is constructed by the head portion 11 and the stem portion 12. More specifically, the head portion 11 and the stem portion 12 are hollowed and the flow channel 14 passes through the head portion 11 and the stem portion 12. The outlets 15 are located on the head portion 11 and connect with the channel 14, so that water can flow out of the flow channel through the outlets 15 to activate hydroelectric generator 2.

The motor 31 and the power switch 32 are respectively fixed inside the head portion 11 and on the stem portion 12. The motor 31 with a central shaft 311, the power switch 32 and the hydroelectric generator 2 are series-connected as a power circuit, and the power switch 32 is used for controlling the power circuit. When the power switch 32 is turned on, the power circuit is closed, afterwards the motor 31 receives electricity from the hydroelectric generator 2 so as to cause the central shaft 311 to rotate. When the power switch 32 is turned off, the power circuit is broken. The transmission mechanism comprises a first gear 51, a second gear 52, a rotating member 61, a rotation slide switch 531, a rotation abutting member 532, a vibration slide switch 621, a vibration abutting member 622, a first elastic member 533, a second elastic member 623 and a third elastic member 43.

A shaft 41 extends axially from two sides of the second gear 52. The third elastic member 43 is slidably installed over one end of the shaft 41. The end of the shaft 41 protrudes through the head portion 11 and connects to the brush 42 with bristles. The shaft 41 installed in the head portion 11 can rotate around its central axis. Further, the third elastic member 43 abutted between the case and the second gear 52 can cause the second gear 52 and the shaft 41 to move linearly, so that the brush 42 and the shaft 41 are driven to make reciprocating motion.

Figure 4:
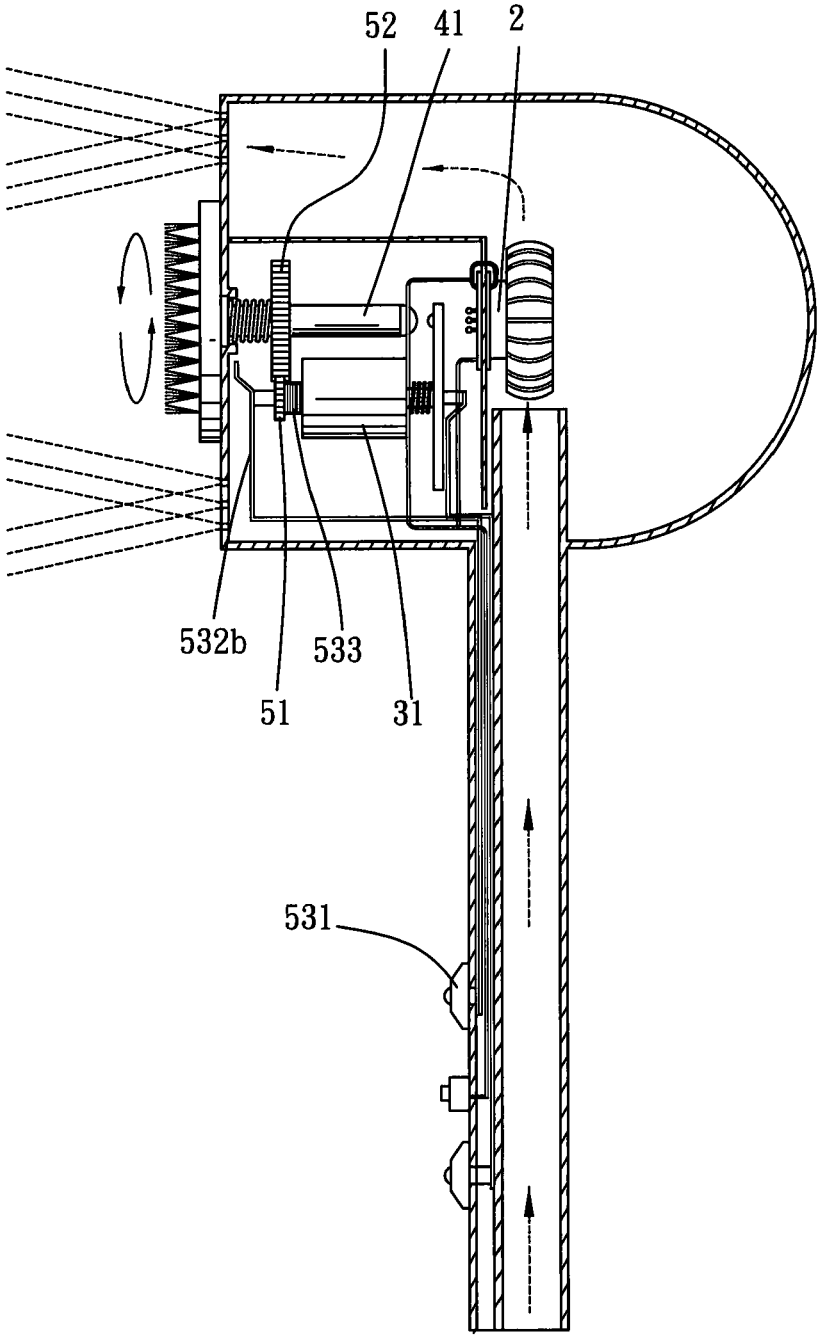

A shaft portion extends from one side of the first gear 51 and the other side of the first gear 51 is slidably installed over the central shaft 331 that form a rotational relation. The first gear 51 and its shaft portion move along its axial direction by the first elastic member 533, which is abutted between the first gear 51 and the motor 31. The rotation slide switch 531 is installed in a limit groove of the stem portion 12. The rotation abutting member 532 comprises a first abutting surface 532*a*, a second abutting surface 532*b* and a first slant portion 532*c*. The first slant portion 532*c* is connected between the first abutting surface 532*a* and the second abutting surface 532*b*. One end of the rotation abutting member 532 abuts against the shaft portion of the first gear 51, and the other end of the rotation abutting member 532 is in a gearing relation with the rotation slide switch 531. When the rotation slide switch 531 slides toward the stem portion 12, the first elastic member 533 abutted between the first gear 51 and the motor 31 causes the shaft portion of the first gear 51 to be disengaged from the second abutting surface 532*b* and to abut against the first abutting surface 532*a*, so that the first gear 51 is disengaged from the second gear 52. Thereby, as shown in FIG. 3, the brush 42 is unable to rotate with the rotation of the motor 31, even though the power switch 32 is turned on. When the rotation slide switch 531 slides toward the head portion 11, the first slant portion 532*c* of the rotation abutting member 532 causes the shaft portion of the first gear 51 to be disengaged from the first abutting surface 532*a* and to abut against the second abutting surface 532*b*, so that the first gear 51 is engaged with the second gear 52. Moreover, as shown in FIG. 4, the motor 31 can drive the brush 42 to rotate when the power switch 32 is turned on at the same time.

Figure 5:
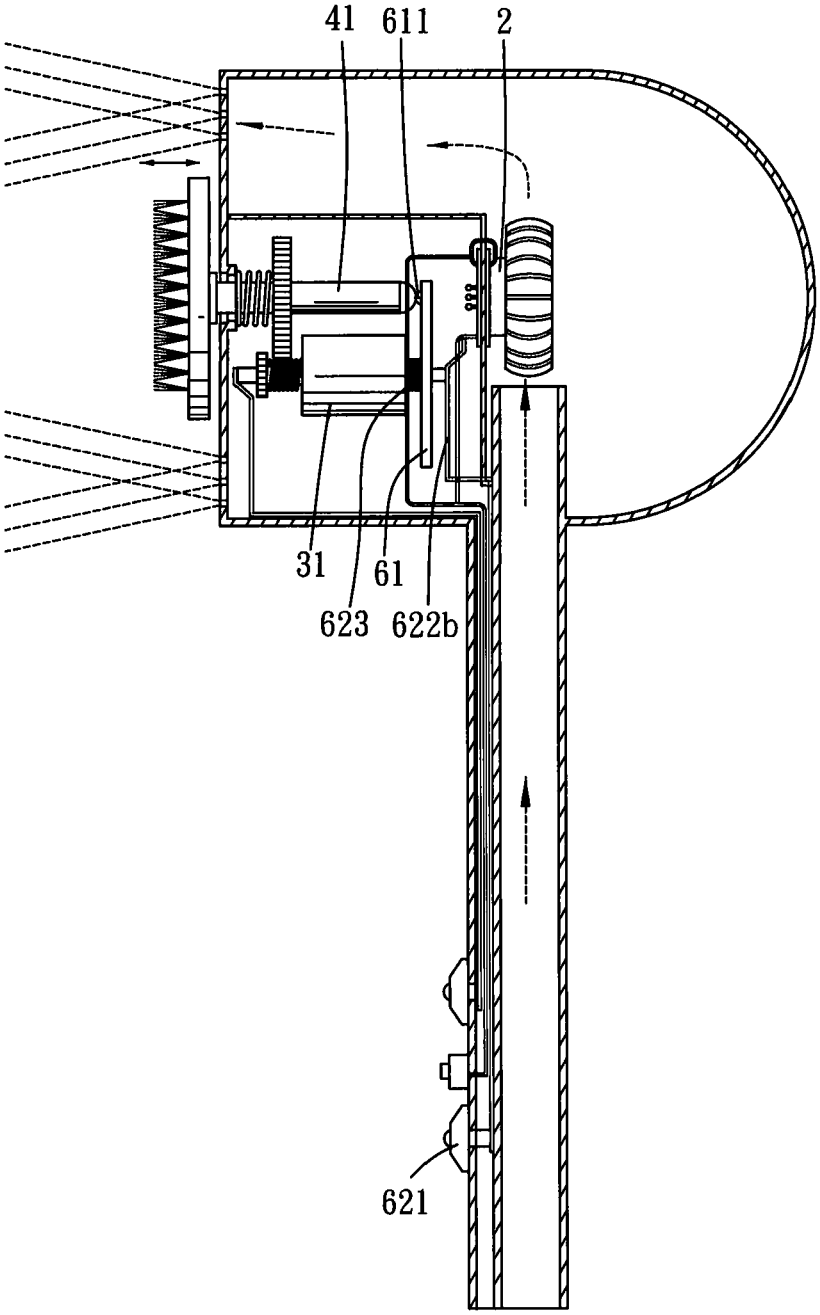

The rotating member 61 is a rotating circular plate. A shaft portion extends from one side of the axle center of the rotating member 61, and a protruding piece 611 protrudes toward the shaft 41 from the other side of the rotating member. The rotating member 61 is slidably installed over the central shaft 311 so that they form a rotational relation. The rotating member 61 and its shaft portion move along its axial direction by the second elastic member 623, which is abutted between the rotating member 61 and the motor 31. The vibration slide switch 621 is installed in another limit groove of the stem portion 12. The vibration abutting member 622 comprises a third abutting surface 622*a*, a forth abutting surface 622*b* and a second slant portion 622*c*. The second slant portion 622*c* is connected between the third abutting surface 622*a* and the forth abutting surface 622*b*. One end of the vibration abutting member 622 abuts against the shaft portion of the rotating member 61, and the other end of the vibration abutting member 622 is in a gearing relation with the vibration slide switch 621. When the vibration slide switch 621 slides toward the stem portion 12, the second elastic member 623 abutted between the rotating member 61 and the motor 31 causes the shaft portion of the rotating member 61 to be disengaged from the forth abutting surface 622*b* and to abut against the third abutting surface 622*a*, so that the protruding piece 611 of the rotating member 61 is disengaged from one end of the shaft 41. Thereby, as shown in FIG. 3, the brush 42 is unable to vibrate with the rotation of the motor 31, even though the power switch 32 is turned on. When the vibration slide switch 621 slides toward the head portion 11, the second slant portion 622*c* of the vibration abutting member 622 causes the shaft portion of the rotating member 61 to be disengaged from the third abutting surface 622*a* and to abut against the forth abutting surface 622*b*, so that the protruding piece 611 of the rotating member 61 hits the end of the shaft 41. Moreover, as shown in FIG. 5, the motor 31 can drive the brush 42 to vibrate when the power switch 32 is turned on at the same time.

Figure 6:
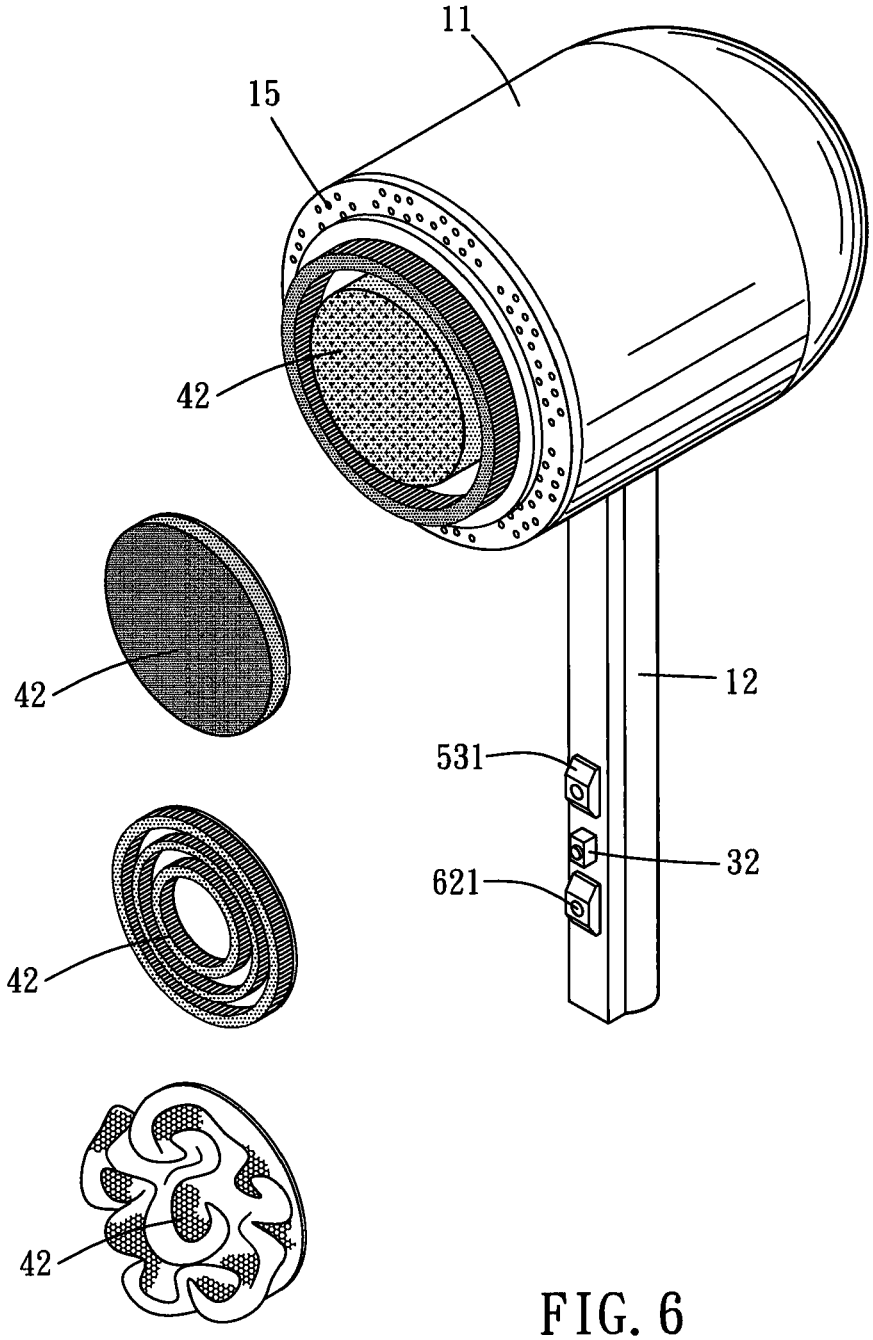
FIG. 6 is a stereogram showing a preferred embodiment of the present invention with different types of brush.

Accordingly, the present invention explains that electricity can be generated by the hydroelectric generator 2, and demonstrates that with the above-mentioned transmission mechanism, the shaft 41 and the brush 42 can rotate and vibrate simultaneously when the rotation slide switch 513 and the vibration slide switch 621 are turned on at the same time. Further, the function of rotation and vibration can be turned off respectively, so that users can choose different function modes. Above-mentioned embodiment of the present invention is to describe the practicality and convenience of the hydroelectric generator, the motor, and the brush inside of the shower head. In other possible embodiments, the transmission mechanism can be omitted and the brush can be directly rotated by a central shaft of a motor, or the brush can be directly vibrated by an eccentric motor. The motor 31 inside of the case can further be installed with a decelerating mechanism, such as a reduction gear group. The motor can also be installed with a rechargeable battery to enhance the power output of the motor. A number of LED bulbs can be installed nearby the outlets 15 and change the colors with different water temperature. The brush 42 installed on the end of the shaft 41 is detachable which the users can change to different types of brushes, as shown in FIG. 6.

What is claimed is:

1. A shower head comprising a case shaped with an inlet, a flow channel and at least one outlet, the flow channel which connects the inlet and the outlet enabling water to flow through, wherein the shower head is characterized in that it also comprises:

a hydroelectric generator, installed inside the case which generates electricity for power supply when water flows through;

a motor, installed inside the case which forms a power circuit together with the hydroelectric generator;

a brush, being in a gearing relation with the motor, the brush making one of two movement—rotation and vibration, with the rotation of the motor;

wherein when users turn on the water tap, water goes through the hydroelectric generator inside the shower head and the motor drives the brush to make one of two movements—rotation and vibration; the shower head allows the users not to only take a shower but also to have body cleaning and body massage.

2. The shower head of claim 1, wherein a power switch installed on the case is series-connected in a power circuit with the motor and the hydroelectric generator, and the power switch is operated for activating the power circuit, so that the brush makes one of two movements—rotation and vibration after receiving electricity from the hydroelectric generator.

3. The shower head of claim 1, wherein the brush installed on the case is detachable, the users can change different types of brushes to match their needs following one of two movements—rotation and vibration, which are caused by the motor.

4. The shower head of claim 1, wherein the shower head is adapted for being installed with a rotating transmission mechanism which comprises a first gear, a second gear, and a rotation slide switch, the first gear and the motor are in a gearing relation, a shaft extends axially from two sides of the second gear, one end of the shaft protrudes through the head portion and connects to the brush, the shaft installed in the head portion can rotate around its central axis, the rotation slide switch is installed on the case and operated to move the first gear along the axial direction, so that the first gear is able to selectively engage with the second gear.

5. The shower head of claim 4, wherein the rotating transmission mechanism also comprises a rotation abutting member and a first elastic member, one end of the rotation abutting member abuts against the shaft portion of the first gear, the other end of the rotation abutting member is in a gearing relation with the rotation slide switch; when the rotation slide switch slides toward the stem portion, the first elastic member abutted between the first gear and the motor causes the first gear to be disengaged from the second gear; when the rotation slide switch slides toward the head portion, the first gear is engaged with the second gear.

6. The shower head of claim 5, wherein the rotation abutting member comprises a first abutting surface, a second abutting surface and a first slant portion, the first slant portion is connected between the first abutting surface and the second abutting surface; when the first gear is disengaged from the second gear, the first abutting surface abuts against the first gear; when the first gear is engaged with the second gear, the second abutting surface abuts against the first gear.

7. The shower head of claim 1, wherein the shower head is adapted for being installed with a vibrating transmission mechanism which comprises a rotating member, a third elastic member, and a vibration slide switch, the brush is installed outside of the case, and one end of the brush is shaped as a shaft penetrating into the case, the rotating member is a rotating circular plate, a shaft portion extends from one side of the axle center of the rotating member, a protruding piece protrudes toward the shaft from the other side of the rotating member, the rotating member is slidably installed over the central shaft that forms a rotational relation with the motor shaft, the third elastic member is slidably installed over the shaft and abutted between the case and the shaft, the vibration slide switch is installed on the case and operated to move the transmission mechanism along the axial direction, so that the protruding piece is able to selectively hit the end of the shaft of the rotating member.

8. The shower head of claim 7, wherein the vibrating transmission mechanism also comprises a vibration abutting member and a second elastic member, one end of the vibration abutting member abuts against the rotating member, the other end of the vibration abutting member is in a gearing relation with the vibration slide switch; when the vibration slide switch slides toward the stem portion, the second elastic member abutted between the rotating member and the motor causes the protruding piece of the rotating member to be disengaged from the end of the shaft; when the vibration slide switch slides toward the head portion, the protruding piece of the rotating member hits the end of the shaft.

9. The shower head of claim 8, wherein the vibration abutting member comprises a third abutting surface, a forth abutting surface and a second slant portion, the second slant portion is connected between the third abutting surface and the forth abutting surface, the third abutting surface abuts against the shaft portion of the rotating member when the protruding piece of the rotating member is disengaged from the end of the shaft, the forth abutting surface abuts against the shaft portion of the rotating member when the protruding piece of the rotating member hits the end of the shaft portion.

* * * * *